US008459972B2

(12) United States Patent
Buell

(10) Patent No.: US 8,459,972 B2
(45) Date of Patent: Jun. 11, 2013

(54) BI-ROTATIONAL HYDRAULIC MOTOR WITH OPTIONAL CASE DRAIN

(75) Inventor: Steven Buell, Sterling Heights, MI (US)

(73) Assignee: MP Pumps, Inc., Fraser, MI (US)

( * ) Notice: Subject to any disclaimer, the term of this patent is extended or adjusted under 35 U.S.C. 154(b) by 583 days.

(21) Appl. No.: 12/712,335

(22) Filed: Feb. 25, 2010

(65) Prior Publication Data

US 2011/0206549 A1 Aug. 25, 2011

(51) Int. Cl.
*F03C 2/00* (2006.01)
*F03C 4/00* (2006.01)
*F04C 2/00* (2006.01)

(52) U.S. Cl.
USPC ..... 418/61.3; 418/206.1; 418/206.6; 418/270

(58) Field of Classification Search
USPC ..... 418/32, 61.3, 104, 132, 206.1, 206.6, 418/206.7, 270
See application file for complete search history.

(56) References Cited

U.S. PATENT DOCUMENTS

| | | | | |
|---|---|---|---|---|
| 4,362,479 | A | 12/1982 | Pahl | |
| 4,480,972 | A | 11/1984 | Zumbusch | |
| 4,881,880 | A * | 11/1989 | Dlugokecki | 418/61.3 |
| 6,174,151 | B1 | 1/2001 | Yarr | |
| 6,193,490 | B1 | 2/2001 | White | |

FOREIGN PATENT DOCUMENTS

| | | | |
|---|---|---|---|
| WO | 20020038956 | A2 | 5/2002 |
| WO | WO 0238956 | A2 | 5/2002 |

* cited by examiner

*Primary Examiner* — Zelalem Eshete

(74) *Attorney, Agent, or Firm* — Katherine H. McGuire, Esq.; Woods Oviatt Gilman LLP

(57) ABSTRACT

A bi-rotational hydraulic motor having a selectively pluggable case drain with check valves incorporated into the thrust plate allowing excess lubrication fluid to pass from the bearings into the outlet port of the motor.

2 Claims, 8 Drawing Sheets

BI-ROTATIONAL HYDRAULIC MOTOR WITH OPTIONAL CASE DRAIN

BACKGROUND OF THE INVENTION

The present invention relates to hydraulically driven motors, and more particularly relates to a gerotor motor having check valves incorporated into a thrust plate of the motor allowing bi-rotational operation with or without a case drain.

Hydraulic motors and gerotors are generally well known, some examples of which may be seen in the following patents:

U.S. Pat. No. 4,480,972 issued Nov. 6, 1984 to Eaton Corporation.

U.S. Pat. No. 6,193,490 issued Feb. 27, 2001 to White Hydraulics, Inc.

U.S. Pat. No. 4,362,479 issued Dec. 7, 1982 to Eaton Corporation.

U.S. Pat. No. 6,174,151 issued Jan. 16, 2001 to The Ohio State University Research Foundation.

While the prior art provides an array of hydraulic motors with varying operational capabilities and efficiencies, there remains a need for a simplified hydraulic motor which may be operated in either the clockwise or counter-clockwise direction with an optional case drain as needed for the particular application requirements.

SUMMARY OF THE INVENTION

The present invention addresses the above need by providing a hydraulic motor in the form of a gerotor motor having first and second ports which may be alternately and selectively used as inlet and outlet ports. Thus, to obtain a clockwise rotation of the motor shaft, the first port is connected to a source of pressurized fluid and thus acts as the inlet port while the second port acts as the outlet port. To obtain a counter-clockwise rotation of the motor, the source of pressurized fluid is connected to the second port and the first port acts as the outlet port.

Check valves are provided in a thrust plate located between the seal area of the motor output shaft and gerotor assembly. The check valve located at the inlet port will close due to the pressure in this area being higher than at the seal area. The check valve at the outlet port will open when the pressure at the outlet port is lower than at the seal area. Should the pressure at the seal area rise, the check valve opens and excess lubrication fluid from the seal area travels through the valve aperture in the thrust plate and empties into the output flow existing at the outlet port. An optional case drain is also provided that is in fluid communication with the seal area via a longitudinally extending bore in the motor shaft. If the application requires a case drain, the plug is removed and excess lubrication fluid is allowed to drain through the case drain outlet. If the case drain is not required, the plug is attached to the case drain outlet port.

DETAILED DESCRIPTION OF A PREFERRED EMBODIMENT

Figure 1:
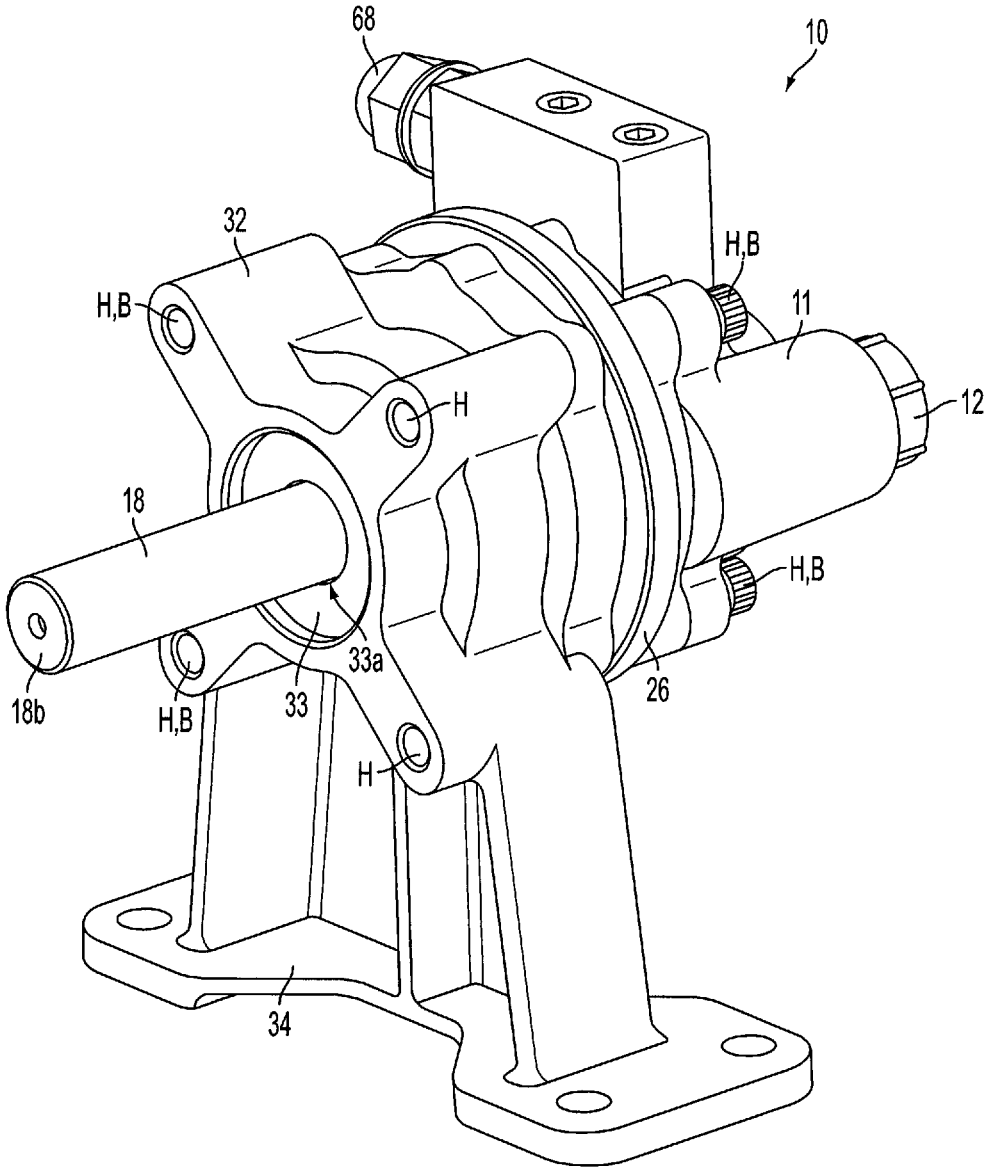
FIG. 1 is a rear perspective view of an embodiment of the invention.
Figure 2:
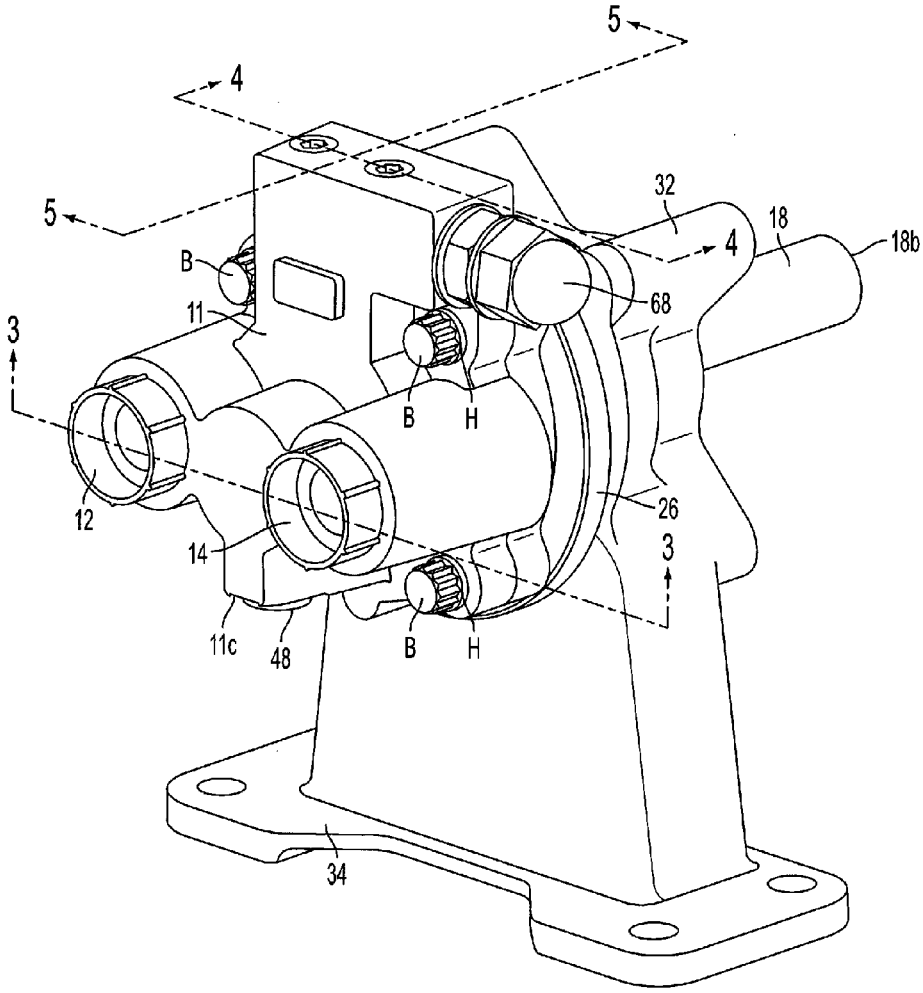
FIG. 2 is a front perspective view thereof.

Referring to the drawing, there is seen in the Figures one embodiment of a bi-rotational hydraulic motor 10 employing the present invention. As explained in detail below, the same motor 10 may be operated in either a clockwise or counter-clockwise manner with or without a case drain depending on the application pressure specifications.

Figure 6:
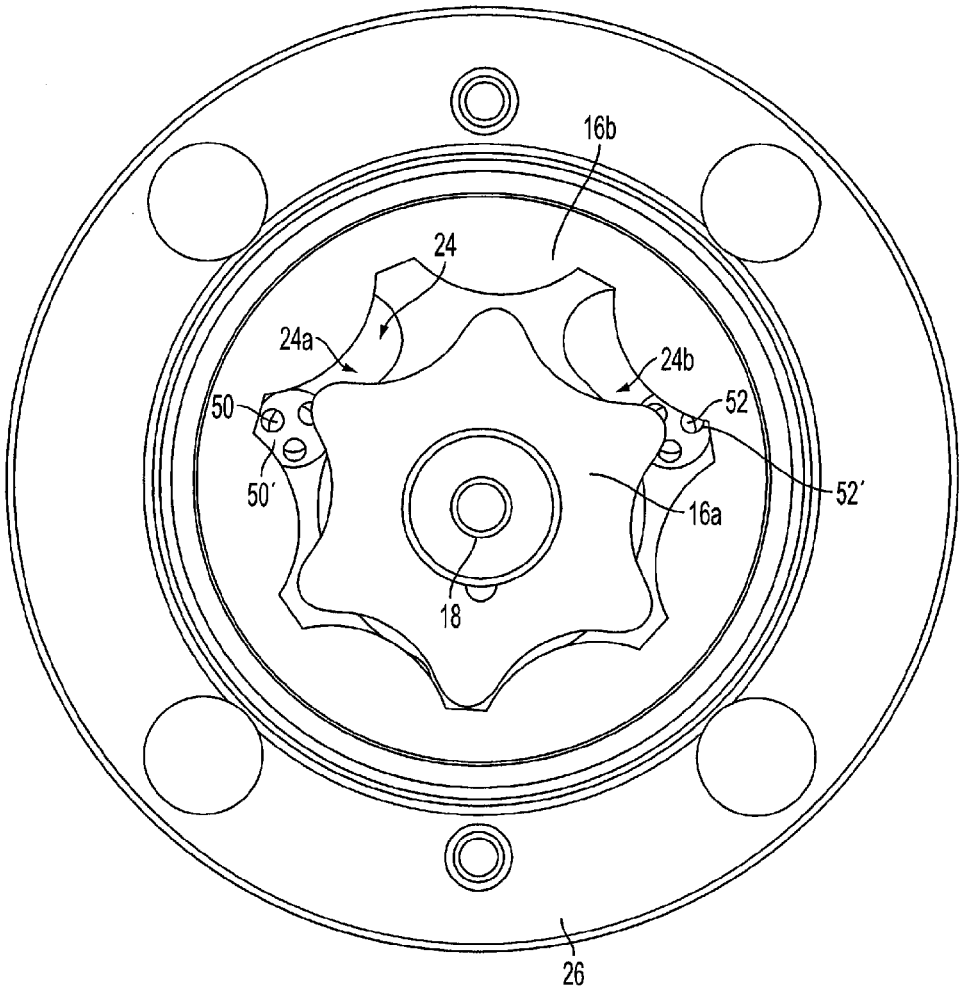
FIG. 6 is a front elevational view of the gerotor, shaft and thrust plate assembly.

Motor 10 includes a first port 12 and a second port 14 formed in a front housing 11 wherethrough hydraulic fluid flows in the manner to be described. A gerotor 16 having an inner rotor 16*a* and outer rotor 16*b* is mounted upon a shaft 18 having first and second ends 18*a*, 18*b*, respectively, with second end 18*b* extending outwardly from housing 20 for connection to a device (not shown) to be driven by motor 10. Shaft 18 is keyed to inner rotor 16*a* and rotates therewith while outer rotor 16*b* rotates within a central opening defined by ring plate 22 in which gerotor 16 is located. Outer rotor 16*b* is axially offset from inner rotor 16*a* to create a variable space 24 therebetween as best seen in FIG. 6.

Clockwise Rotation Operation

Figure 3:
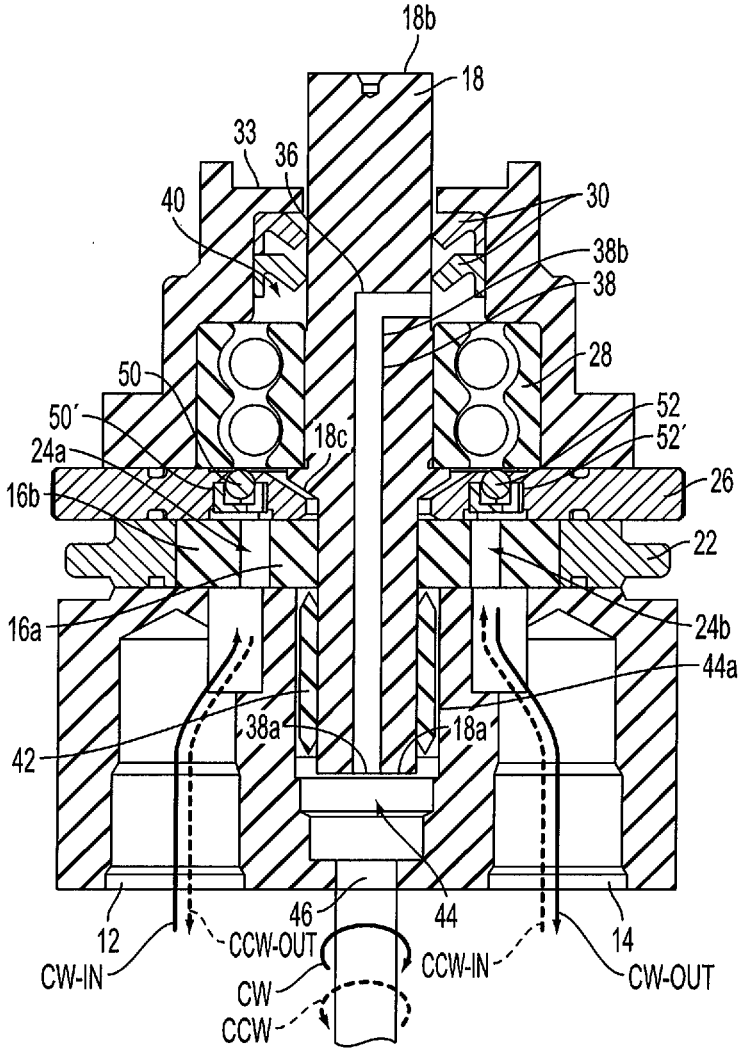
FIG. 3 is a cross sectional view as taken generally along the line 3-3 in FIG. 2.
Figure 8:
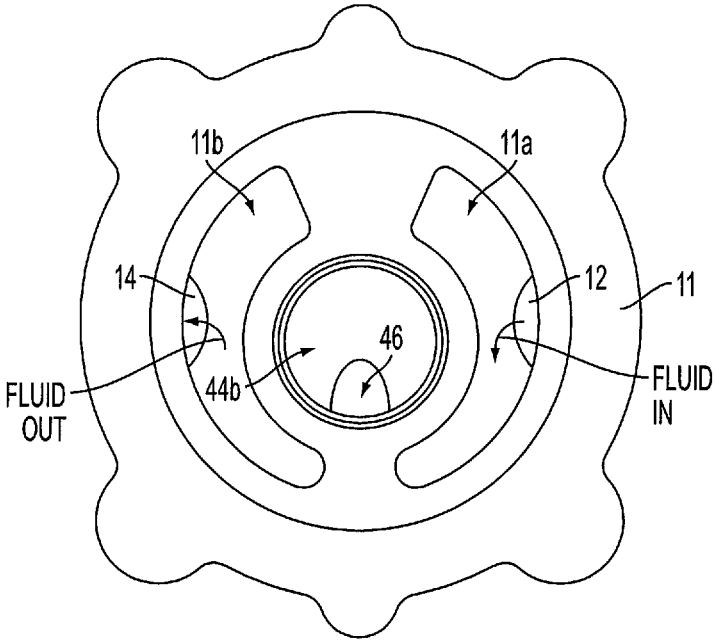
FIG. 8 is a rear elevational view of interior cavity of the front housing.

Description will first be directed to obtaining a clockwise ("CW") rotation of shaft 18 as viewed looking into ports 12, 14 in FIG. 3. To obtain a clockwise "CW" rotation of shaft 18, working fluid under pressure is directed into first port 12 which thus acts as an inlet port. The working fluid entering port 12 is represented by the solid arrow labeled "CW-IN" in FIG. 3. Working fluid exits the motor at second port 14 which thus acts as an outlet port in this instance, with the fluid exiting port 14 represented by the solid arrow labeled "CW-OUT". Working fluid thus enters port 12 and is directed into space 24 between inner rotor 16*a* and outer rotor 16*b* (see FIG. 6). The geometry of space 24 is such that high pressure fluid entering the area of space 24 adjacent first check valve 50 will urge a clockwise "CW" rotation of gerotor inner rotor 16*a* and outer rotor 16*b*. Reference is also made to FIG. 8 which shows the interior configuration of front housing 11 which includes a first tapered crescent-shaped cavity 11*a* in fluid communication with port 12 and which is aligned with gerotor space 24*a* at the inlet side. A second tapered crescent-shaped cavity 11*b* is in fluid communication with port 14 and is aligned with gerotor space 24*b* at the outlet side.

Figure 4:
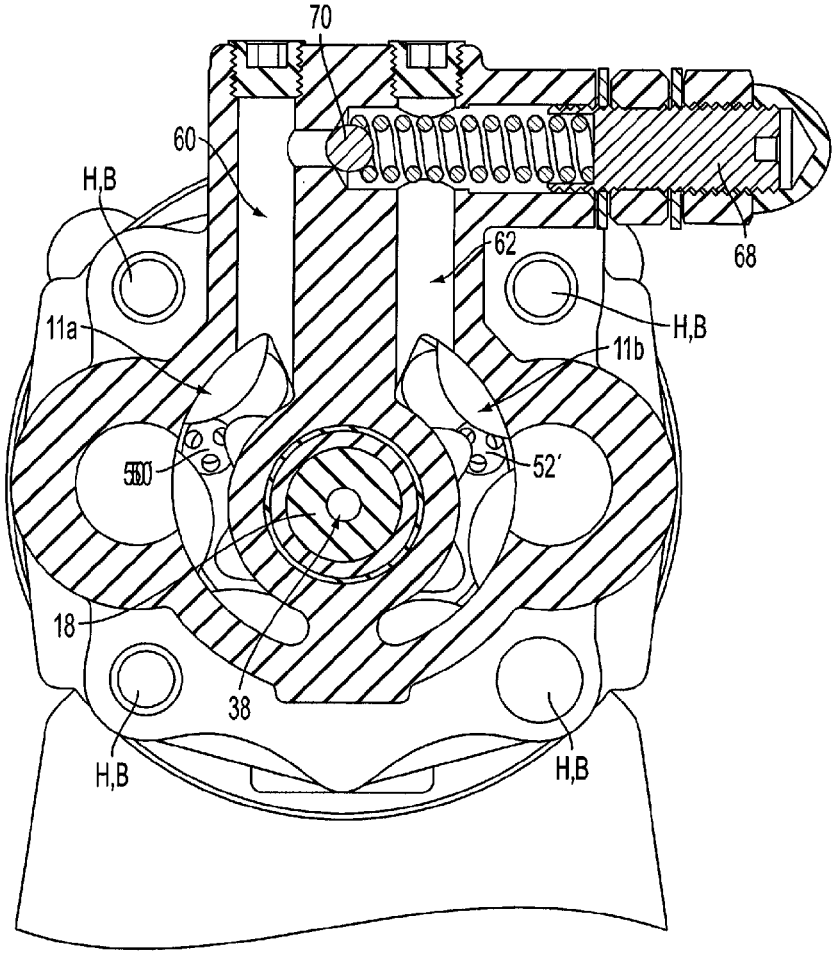
FIG. 4 is a cross sectional view as taken generally along the line 4-4 in FIG. 2.

Referring to FIGS. 3 and 4, fluid is captured in space 24*a* between the rotors 16*a, b* and travels therewith in a clockwise direction for an approximately 180 degree rotation whereupon the working fluid is directed out of motor 10 through port 14. As explained above, the high pressure working fluid entering space 24*a* causes a clockwise "CW" rotation of gerotor 16 and thereby causing a clockwise "CW" rotation of shaft 18 to drive a device connected to motor 10.

Figure 5:
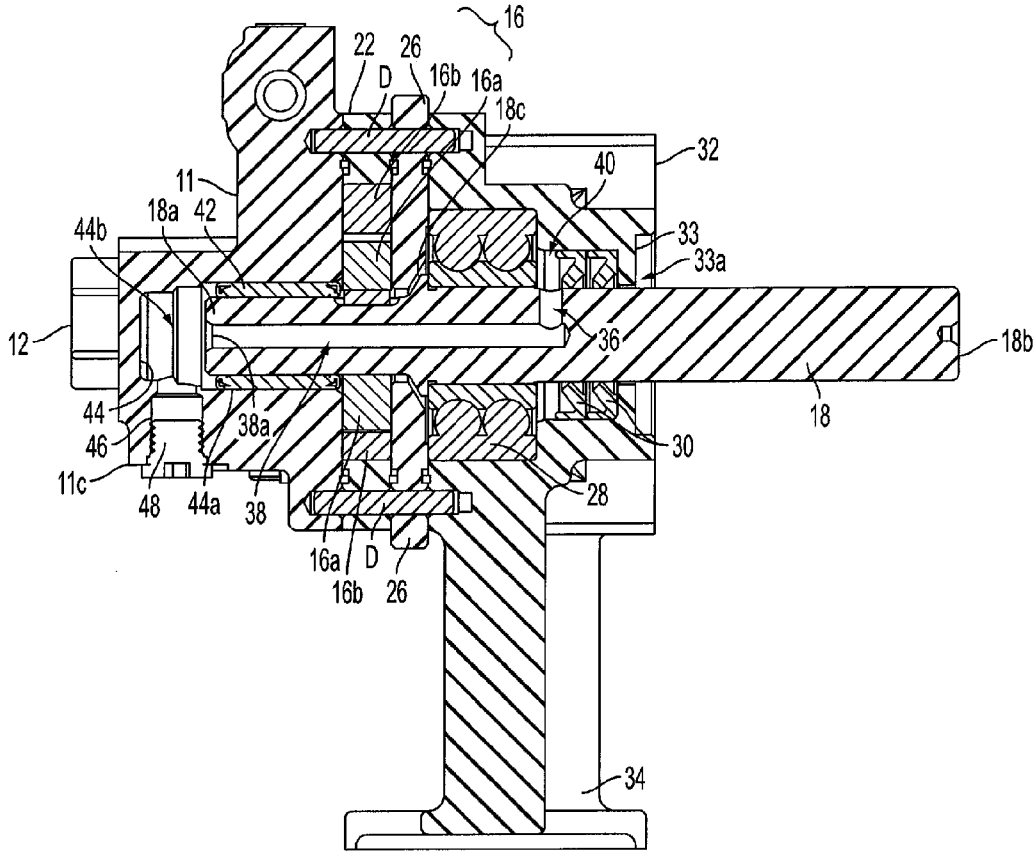
FIG. 5 is a cross sectional view as taken generally along the line 5-5 in FIG. 2.

A thrust plate 26, bearings 28 and seals 30 are located on the side of gerotor 16 opposite ports 12, 14. Thrust plate 26 is mounted on shaft 18 between gerotor 16 and a tapered shoulder 18*c* defined on shaft 18. A bearing assembly having one or more bearings, for example a double-race bearing 28 as shown, is mounted on shaft 18 adjacent to and on the side of thrust plate 26 opposite gerotor 16. One or more lip seals 30 are mounted on shaft 18 adjacent to and on the side of bearing 28 opposite thrust plate 26. Bearing 28 and lip seals 30 may be enclosed in a rear housing 32 having a radially inwardly extending flange 33 defining an aperture 33*a* wherethrough shaft 18 extends exteriorly of rear housing 32 (see FIGS. 1 and 5). Rear housing 32 may further include an optional integral mounting stand 34. A plurality of respectively aligned bore holes "H" and bolts "B" are used to secure the front and rear housing together with the various other parts of motor 10 therebetween which may have further alignment and/or securing elements such as dowels "D" seen in FIG. 5.

During clockwise "CW" operation of motor 10, lubrication of bearing 28 is provided by hydraulic fluid from inlet port 12 which leaks along shaft 18 past gerotor 16 and thrust plate 26 to and through bearing 28.

Lip seals 30 prevent fluid from travelling any further along shaft 18 exteriorly of rear housing 32. Lip seals 30 have a predetermined maximum pressure rating which, if exceeded, may cause premature failure of the seals 30 and a breakdown of the components of motor 10. It is therefore required that the pressure in bearing 28 and seal area not exceed the maximum pressure rating of the seals 30 as discussed further below.

Shaft 18 includes a cross-drilled hole 36 which opens to the space 40 defined between bearing 28 and lip seal 30. Hole 36 extends radially inwardly inside shaft 18 and connects to a first end 38*b* of a longitudinally extending axial passageway 38 which extends through the center of shaft 18 to an opening 38*a* at first shaft end 18*a*. Shaft first end 18*a* telescopes within a needle bearing 42 which is located within a cooperatively formed bearing wall 44*a* of central cavity 44 formed in front housing 11. Shaft opening 38*a* is in fluid communication with central cavity section 44*b* wherein hydraulic fluid may enter from passageway 38. A cross-drilled hole 46 extends from cavity section 44*b* to the outer bottom wall of front housing 11 to form a case drain which may be opened or closed with a removable plug 48 as required as will be explained further below.

As stated above, lubrication of bearing 28 is provided by hydraulic fluid which has entered inlet port 12 and leaked along shaft 18 past gerotor 16 and thrust plate 26 (hereinafter referred to as "lubrication fluid"). Lubrication fluid thus passes through bearing 28 and may accumulate in space 40 defined in part by seal 30, and continue flowing through cross hole 36 and passageway 38 to front housing cavity 44*b* whereupon it stops if plug 48 is in place.

Figure 7:
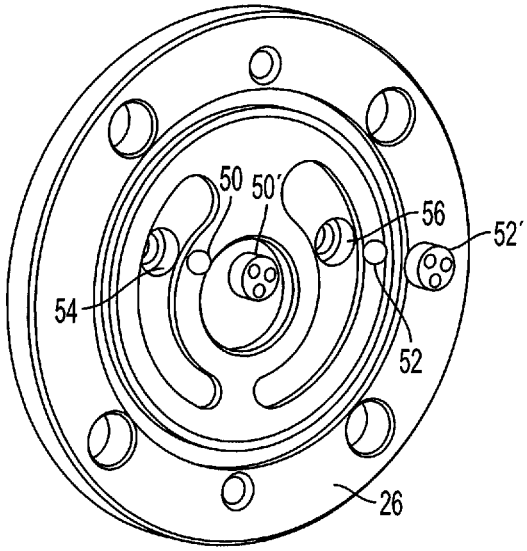
FIG. 7 is a perspective view of the thrust plate with the check valves in spaced relation thereto.

As seen best in FIGS. 3 and 7, thrust plate 26 is seen to include first and second ball check valves and caps 50, 50' and 52,52' located in respective first and second apertures 54, 56, respectively, with first check valve 50 seating (closing) when the pressure at the gerotor side of thrust plate 26 at the location of check valve 50 is higher than the pressure at the bearing side of thrust plate 26. Conversely, second check valve 52 unseats (opens) when the pressure at the bearing side of thrust plate 26 is higher than the pressure at the gerotor side of thrust plate 26 at the location of second check valve 52. When in the open position, fluid is allowed to flow through the opening formed in the thrust plate and the one or more openings formed in the respective valve cap 52'. Since the hydraulic fluid source supplied to inlet port 12 is supplied at a high pressure, it will always be higher than the pressure of the lubricating fluid at bearing 28 and the seal area and first check valve 50 will remain seated. As explained above, the high pressure fluid entering input port 12 causes a clockwise "CW" rotation of gerotor 16 which in turn causes a clockwise "CW" rotation of shaft 18. Upon reaching the outlet side, the fluid pressure is much lower and the fluid exits motor 10 at outlet port 14. The pressure of fluid at the gerotor side of second check valve 52 is thus lower than at first check valve 50. In a typical application of motor 10, the pressure of the lubricating fluid at second check valve 52 at the bearing side will be higher than the pressure of the exiting working fluid at the gerotor side and second check valve 52 will thus unseat allowing lubricating fluid to flow through thrust plate hole 56 and pass through to outlet 14.

In certain applications of motor 10, the passage of lubricating fluid through aperture 56 is sufficient to maintain a safe pressure at the seal area (i.e., a pressure that does not exceed the maximum pressure rating of the seal). In this instance, a case drain is not required and plug 48 may remain in place. In other applications of motor 10, the passage of lubricating fluid through aperture 56 is not sufficient to maintain a safe seal pressure thereby requiring removal of case plug 48 so that lubricating fluid can also travel through shaft channels 36 and 38 and exit at the case drain and thereby reduce the pressure at the seal area.

Referring to FIG. 4, front housing 11 is further provided with first and second conduit lines 60, 62 with first line 60 extending to the high pressure side of gerotor 16 and second line 62 extending to the low pressure side of gerotor 16. Should the pressure or flow rate of hydraulic fluid entering inlet port 12 be too high so as to push too much fluid past gerotor 16 to bearing 28 (and thus possibly damaging the seal 30), fluid may be drawn off the high pressure side by turning and retracting screw 68 which opens a spring loaded ball check valve 70 which allows fluid to travel from conduit line 60 to conduit line 62 which dumps the excess fluid into the return line at exit port 14.

Counter-Clockwise Rotation Operation

Discussion is now turned to operating motor 10 in a counter-clockwise "CCW" manner Referring again to FIG. 3, working fluid under pressure as represented by the dashed line labeled "CCW-IN" is now delivered into port 14 which is thus now acting as the inlet port. The working fluid is directed into space 11*b* in front housing 11 and proceeds to the space 24*b* defined between inner and outer rotors 16*a*, 16*b*, respectively, thereby urging a counter-clockwise "CCW" rotation of the rotors and thus also the shaft 18. Since the inlet pressure at port 14 is higher than the seal area, check valve 52 will seat in aperture 56. Working fluid will leak from inlet 14 along shaft 18 past gerotor 16 and thrust plate 26 to enter bearing 28 and space 40 adjacent seals 30 to lubricate the same. Working fluid captured by gerotor 16 will translate approximately 180 degrees and exit at what is now the outlet port 12 as represented by the dashed arrow labeled "CCW-OUT" in FIG. 3. When the pressure at outlet port 12 is lower than at the seal area, check valve 50 will unseat allowing lubricating fluid to travel from the seal area through aperture 54 and out exit port 12. If this is not sufficient to maintain a safe pressure at the seal area, plug 48 may be removed to allow fluid to travel through shaft channels 36 and 38 and exit at the case drain and thereby reduce the pressure at the seal area.

It will thus be appreciated that the same motor 10 may be operated in either a clockwise or counter-clockwise manner with or without a case drain depending on the application pressure specifications.

What is claimed is:

1. A bi-rotational hydraulic motor comprising:

a) a rotatable shaft having a longitudinal axis extending between first and second ends, said first end adapted to connect to a device to be driven by said motor;

b) a gerotor having inner and outer rotors, said inner rotor mounted to said shaft and rotatable therewith;

c) first and second ports in fluid communication with said gerotor;

d) a thrust plate mounted on said shaft adjacent said gerotor opposite said first and second ports, said thrust plate including first and second check valves formed therein and in fluid communication with said first and second ports, respectively;

e) a bearing and seal assembly mounted on said shaft adjacent said thrust plate opposite said gerotor, said bearing and seal assembly adapted to receive lubricating fluid from either of said first and second ports; and f) a selectively pluggable case drain located adjacent said shaft second end, and wherein said shaft includes a fluid conduit extending from said second end to a position adjacent said first end, said shaft fluid conduit in fluid communication with said bearing and seal assembly adjacent said first end and said case drain at said second end, said case drain when unplugged allowing fluid to travel from said bearing and seal assembly said fluid conduit and said case drain;

wherein said motor may be operated to rotate said shaft in either a clockwise or counter-clockwise direction by attaching a source of pressurized fluid to a selected one of said first and second ports, said selected port defining the inlet port and the other of said first and second ports defining the outlet port, and wherein the check valve located adjacent said inlet port closing upon sensing a fluid pressure at said inlet port higher than at said bearing and seal assembly, said bearing and seal assembly receiving lubricating fluid from said inlet port along said shaft, the check valve located adjacent said outlet port opening upon sensing a pressure at said bearing and seal assembly higher than at said outlet port whereupon fluid in said bearing and seal assembly may pass through said check valve and exit said motor through said outlet port.

2. The motor of claim 1 and further comprising first and second conduit lines in fluid communication with said first and second ports, respectively, and further comprising a valve located between said first and second conduits, said valve selectively movable between an open condition which allows fluid communication between said first and second ports via said first and second conduits, and a closed condition which prevents fluid communication between said first and second ports via said first and second conduits, respectively.

* * * * *